US006209497B1

(12) United States Patent
Niethammer et al.

(10) Patent No.: US 6,209,497 B1
(45) Date of Patent: Apr. 3, 2001

(54) DEVICE FOR CHANGING THE RELATIVE ROTATIONAL POSITION OF A SHAFT TO THE DRIVE WHEEL

(75) Inventors: Bernd Niethammer, Nuertingen; Andreas Knecht, Ammrbuch, both of (DE)

(73) Assignees: Dr. Ing. h,c.F. Porsche Aktiengesellschaft, Stuttgart; Hydraulik Ring GmbH, Nuertingen, both of (DE)

( * ) Notice: Subject to any disclaimer, the term of this patent is extended or adjusted under 35 U.S.C. 154(b) by 0 days.

(21) Appl. No.: 09/463,447

(22) PCT Filed: Apr. 14, 1999

(86) PCT No.: PCT/EP99/02505

§ 371 Date: Apr. 4, 2000

§ 102(e) Date: Apr. 4, 2000

(87) PCT Pub. No.: WO99/61759

PCT Pub. Date: Dec. 2, 1999

(30) Foreign Application Priority Data

May 27, 1998 (DE) ..... 198 23 619

(51) Int. Cl.[7] ..... F01L 1/344

(52) U.S. Cl. ..... 123/90.17; 123/90.31; 74/568 R; 464/2; 464/160

(58) Field of Search ..... 123/90.15, 90.17, 123/90.31; 74/568 R; 464/1, 2, 160

(56) References Cited

U.S. PATENT DOCUMENTS 5,520,145 * 5/1996 Nagai et al. ..... 123/90.17
5,669,343 * 9/1997 Adachi ..... 123/90.17
6,129,060 * 10/2000 Koda ..... 123/90.17

FOREIGN PATENT DOCUMENTS

0829621A2 3/1998 (EP) .
0896129A1 2/1999 (EP) .

* cited by examiner

*Primary Examiner*—Weilun Lo
(74) *Attorney, Agent, or Firm*—Evenson, McKeown, Edwards & Lenahan, P.L.L.C.

(57) ABSTRACT

The system according to the invention for the relative rotating position change of a shaft with respect to a driving wheel has an adjusting device with two pressure spaces which act against one another and which can be acted upon by a pressure medium pump. In order to achieve a uniform controlled adjusting operation and a secure position fixing, the pressure space connected with the pressure medium pump is acted upon by pressure at the start of the adjusting movement before the opposite pressure space connected with the pressure medium tank is relieved.

15 Claims, 1 Drawing Sheet

DEVICE FOR CHANGING THE RELATIVE ROTATIONAL POSITION OF A SHAFT TO THE DRIVE WHEEL

BACKGROUND AND SUMMARY OF THE INVENTION

The invention relates to a system for the relative rotating position change of a shaft with respect to the driving wheel, particularly of a camshaft of an internal-combustion engine.

Such a system is known, for example, from International Patent Document WO 95/31633. This document describes a system for the rotating position change of the camshaft of an internal-combustion engine, in which the camshaft is non-rotatably connected with an internal geared wheel which has radial webs which divide assigned cells of a cell wheel into two pressure spaces respectively which operate against one another. By way of a chain drive or belt drive, this cell wheel is driven by the crankshaft of an internal-combustion engine. Pressure is admitted to the respective pressure spaces by way of a control valve which is constructed as a 4/3-way valve and by means of which the pressure spaces are connected as a function of the desired rotating position change with a pressure medium pump or a pressure medium tank. For this purpose, one pressure line respectively leads from this control valve to all pressure spaces acting in the same direction. Furthermore, one return valve respectively is arranged in these pressure lines which can be hydraulically unblocked and whose blocking effect can in each case be abolished by the pressure in the other pressure line. In the neutral position of the control valve, while neglecting the leakage losses, a hydraulic clamping can be achieved of the two components, which can be rotated relative to one another, by way of these return valves. However, such a system requires relatively high expenditures. Furthermore, during the adjusting operation, because of the almost unthrottled connection of one pressure space group with the pressure medium tank, unintended position deviations and inaccurate or fluctuating adjusting operations can occur.

In addition, from U.S. Pat. No. 4,858,572, a system is known for the rotating position change, in which an internal part is non-rotatably connected with the end of the camshaft and has on its exterior side several radial slots which are distributed along the circumference and in which wing elements are guided in a radially displaceable manner. This internal part is surrounded by a cell wheel which has several cells which can be acted upon hydraulically and which, by means of the wings, are divided into two pressure spaces which act against one another upon the latter. By admitting pressure to these pressure spaces, as a function of the pressure difference, the cell wheel can be rotated relative to the internal part and thus relative to the camshaft. Furthermore, one piston respectively, which can be acted upon hydraulically, is guided in the cell wheel in two radial bores in defined angular positions, which piston can be pushed into a radial indentation of the internal part in the assigned end position of the system. By means of pressure spring elements, these pistons are acted upon in the direction of the internal part and can be displaced in the opposite direction by the hydraulic action upon the bores in the internal ring. By means of these spring-loaded pistons, the system is to be locked in one of its two end positions as long as the pressure for acting upon the pressure spaces does not reach a defined level. Only when a defined pressure level is reached, will the pistons be pushed back against the effect of the pressure springs and will permit a rotating of the internal part relative to the cell wheel. By means of such a system, rattling noises, among others, are to be avoided when the internal-combustion engine is started, which rattling noises may occur as the result of changing torque loads during the start and the operation of the internal-combustion engine.

In contrast, the invention is based on the object of improving the system of the above-mentioned type for the relative rotating position change of a shaft with respect to the driving wheel such that it is constructed in a simpler manner and at more reasonable cost and permits a rotating position change which is free of fluctuations. The main object is the avoidance of the use of several high-expenditure high-cost control valves.

Furthermore, when the internal-combustion engine is stopped and in the steady-state operation of the system, a simply operating hydraulic locking is to be permitted.

According to the invention, this object is achieved by providing a system for the relative rotating position change of a shaft with respect to the driving wheel, particularly of a camshaft of an internal-combustion engine, having an adjusting arrangement with two pressure spaces acting against one another, having a pressure medium pump, a pressure medium tank and at least one control valve, during the adjusting operation, one pressure space being connected with the pressure medium pump and the other pressure space being connected with the pressure medium tank, characterized in that, at the start of an adjusting operation, one pressure space is connected with the pressure medium pump before the other pressure space is connected with the pressure medium tank.

Because of the fact that, when the adjusting operation is initiated, one pressure space is connected with the pressure medium pump, before the other pressure space, which operates in the opposite direction, is connected with the pressure medium tank, it is prevented that the pressure drop on the side to be relieved takes place faster than the pressure rise on the opposite side. This results in a damping or throttling of the outflow side by means of which an adjustment is prevented which is in advance of the pressure rise. The adjusting operation thereby becomes damped and more precise. Such a control of the pressure admission and pressure relief permits the avoidance of high-expenditure damping devices and allows in a simple manner a controlled regulating or a controlled conversion of the adjusting movement as the result of the pressure control.

A damping or throttling on the outflow side, which functions during the whole adjusting operation, is achieved in that the control cross-section to the pressure medium tank during the adjusting operation is always smaller than the opening cross-section to the pressure medium pump. As a result, during the whole adjusting operation, an advancing before the pressure rise is prevented so that a very precise position assignment and a largely fluctuation-free adjustment is possible during the whole adjusting operation.

A particularly advantageous construction of the system for the relative rotating position change which is reasonable in cost is obtained if the inflow control as well as the outflow control for the assigned rotating direction is controlled by way of a common valve element of the control valve.

Such a system for the relative rotating position change will be even more simplified and lower in cost if a common control valve and a common valve element are utilized for both directions of the rotating position change.

In this case, the control valve may be constructed in a particularly advantageous manner as a 4/3-way valve, the valve element acting for the inflow and outflow control for both rotating direction being constructed as a valve slide.

Additional advantages and advantageous further developments of the invention are found in the description.

An embodiment of the invention will be explained in detail in the following description and drawing.

DETAILED DESCRIPTION OF THE DRAWINGS

Figure 2:
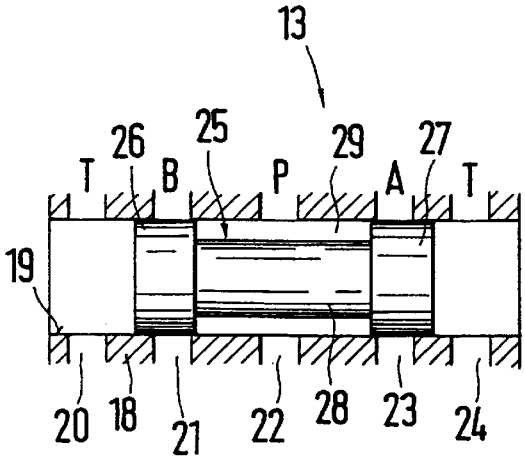
FIG. 2 is a schematic representation of the control valve.
Figure 1:
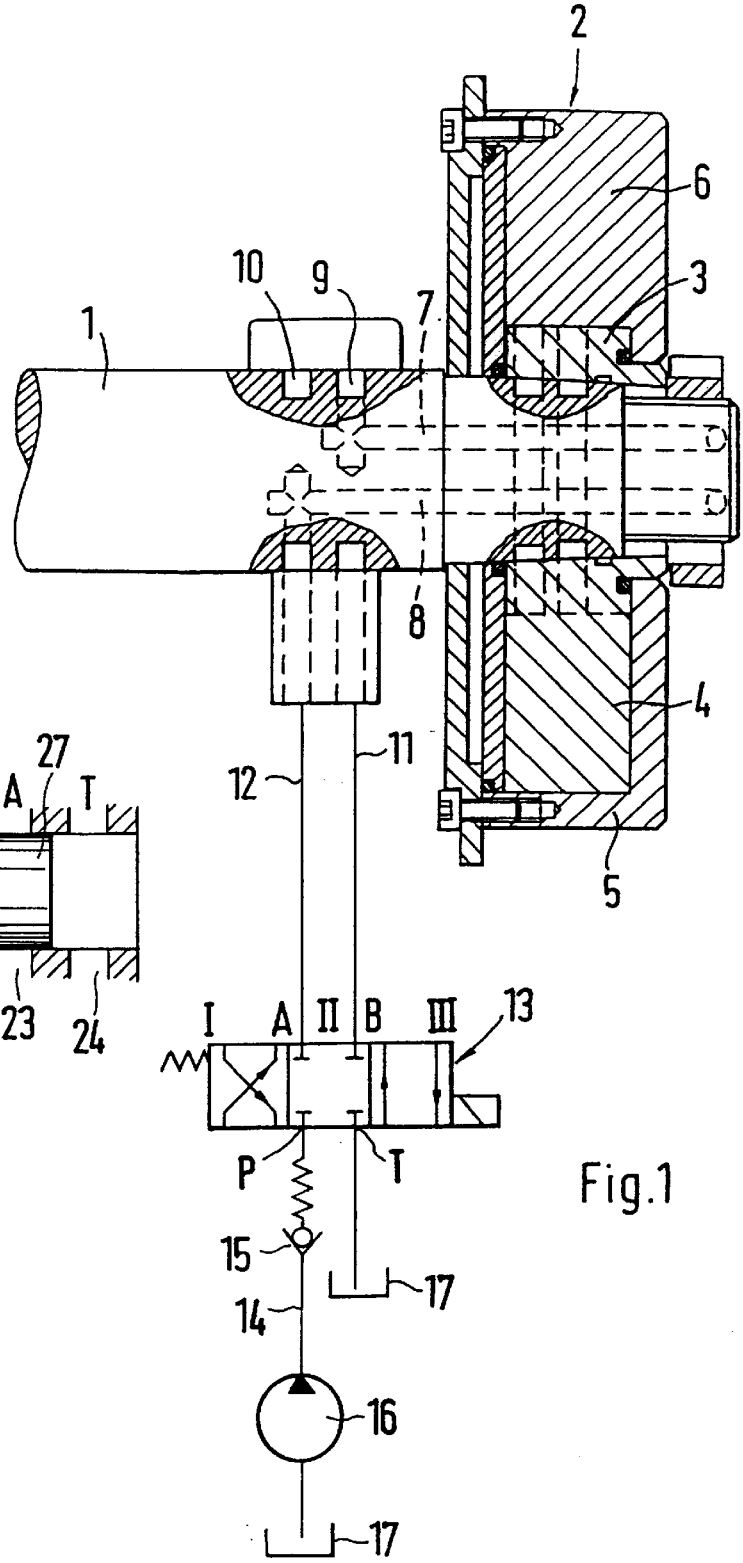
FIG. 1 is a schematic representation of the pressure medium supply for a phase-variable camshaft drive.

In the drawing, reference number 1 indicates the camshaft of an internal-combustion engine, on which, on the end side, a system for the hydraulic rotating angle adjustment of the camshaft relative to its driving wheel or to the crankshaft is arranged, which is known, for example, from German Patent Document DE 39 37 644 A1. This adjusting system 2 has an internal part 3 which is non-rotatably connected with the camshaft and which is provided with radial webs 4. These webs 4 divide the cells of a cell wheel 5 bounded by radial webs 6 into two pressure spaces respectively which act in opposite directions. The cell wheel 5 is simultaneously a driving wheel and is connected, for example, by means of a chain drive or belt drive with the crankshaft of the internal-combustion engine. By the corresponding admission of pressure to the pressure spaces, the internal part 3 connected with the camshaft 1 can be rotated relative to the cell wheel 5 so that the phase positions of the cams operating the charge cycle valves will change.

The hydraulic control of the pressure spaces takes place by two pressure ducts 7 and 8 which are constructed separately from one another in the camshaft and which are connected by way of two ring grooves 9 and 10 constructed in a camshaft bearing 9 with one control line 11 and 12 respectively. The two control lines 11 and 12 are connected with a control valve 13 which, in this embodiment, is constructed as a 4/3-way valve. The connection of the control valve 13 to the control line 11 is marked A; the connection to the control line 12 is marked B. The control valve 13 has a pressure connection P and a return flow connection T. By way of a pressure line 14 and a return valve 15, the pressure connection P is connected with the lubricant pump 16 of the internal-combustion engine which is used as a pressure medium source. This lubricant pump 16, in turn, is connected by way of a suction line with the oil tank 17 or the oil pan of the internal-combustion engine. The return flow connection T of the control valve 13 is also connected with this oil tank 17.

In the neutral position II of the control valve 13, the pressure line 14 as well as the return flow connection T and the two control lines 11 and 12 are closed on the valve side. In switching position I of the control valve 13, the pressure line 14 is connected with the control line (P→B). The control line 12, in turn, is connected by way of the return flow connection T with the oil tank 17 (A→T). In switching position III of the control valve 13, the pressure line 14 is connected with the control line 12 (P→A), while the control line 11 to the oil tank 17 is opened up (B→T). Because of the pressure differences existing in the respective connected pressure spaces, a rotation of the internal part relative to the cell wheel takes place in both switching positions I and III of the control valve 13. For example, in switching position I, a clockwise rotation of the internal part takes place relative to the cell wheel, while in switching position III, the relative rotation takes place counterclockwise. In the neutral position II, the relative position of the two rotatable components of the adjusting system is maintained or fixed by the hydraulic clamping.

The control valve 13 constructed as a 4/3 proportional way valve has a valvet housing 15 with a valve bore 19 which is surrounded by five mutually spaced ring grooves. In the arrangement illustrated in FIG. 2, these five ring grooves have the reference numbers 20 to 24 extending continuously from the left to the right. In this case, the ring grooves 20 and 24 are connected in a manner known per se with the return flow connection T. The ring groove 21 is connected with the pressure connection B, while the ring groove 23 is connected with the pressure connection A. The central ring groove 22 is connected with the pressure connection P. A valve element 25, which is constructed as a control piston, is guided in a sealing and longitudinally displaceable manner in the valve bore 19. This valve element 25 has two spaced piston sections 26 and 27 which are sealingly guided in the valve bore 19 and which are connected with one another by way of a piston section 28 of a smaller diameter. The two piston sections 26 and 27 close off the annulus 29 constructed between the piston section 25 and the wall of the valve bore 19. The length of the piston section 25 and the length of the piston sections 26 and 27 are adapted such to the width and the spacing of the ring grooves 20 to 24 that the ring grooves 21 and 23 are tightly closed by the piston section 26 and 27 in the neutral position II of the control valve 13. The distance between the two mutually facing front sides of the piston sections 26 and 27 is smaller by an amount required for the secure sealing than the distance between the mutually facing sides of the ring grooves 21 and 23. The length of the piston sections 26 and 27 is selected such that the covering of the ring grooves 21 and 23 on the front side facing away from the pressure connection P is clearly larger. If the valve element 25 is displaced from the neutral position II illustrated in FIG. 2, for example, toward the right into the switching position I, the area of the ring groove 23 facing the pressure connection P is no longer covered or is opened up by the piston section 27. On the opposite side, the ring groove 21 is still completely covered by the piston section 26 as the result of the larger covering. Thus, at the start of the adjusting operation, the pressure space assigned to the pressure connection B can therefore be acted upon without relieving the opposite pressure space assigned to the pressure connection A. Only when the valve element 25 is displaced further toward the right, the ring groove 21 is also no longer covered by the piston section 26 on the side facing the ring groove 20 and is opened up by this piston section 26 so that the connection A is opened toward T. The dimensions and spacings of the ring grooves are coordinated such with the dimensioning of the valve element that the opening cross-section—when the valve element is displaced toward the right—on the ring groove 23 is always larger than on the ring groove 21 (outflow edge control). If the valve element 25 is analogously displaced from the neutral position II toward the left into the switching position III, the side of the ring groove 21 facing the pressure connection P is no longer covered by the piston section 26. On the other hand, because of the larger covering, the piston section 27 still completely covers the ring groove 23. Only when the valve element 25 is displaced further toward the left, the ring groove 23 is analogously no longer covered on the side facing the ring groove 24. Also here, the opening cross-section of the ring groove 21—during a displacement of the valve element 25 toward the left—is always larger than that on the ring groove 23.

What is claimed is:

1. A system for the relative rotating position change of a camshaft with respect to a driving wheel of an internal-combustion engine, having an adjusting arrangement with two pressure spaces acting against one another, having a pressure medium pump, a pressure medium tank and at least one control valve, during the adjusting operation, one pressure space being connected with the pressure medium pump and the other pressure space being connected with the pressure medium tank, characterized in that, at the start of an adjusting operation, one pressure space is connected with the pressure medium pump before the other pressure space is connected with the pressure medium tank.

2. The system for the relative rotating position change of a shaft with respect to the driving wheel according to claim 1, characterized in that the control cross-section of the connection of one pressure space to the pressure medium tank during the adjusting operation is always smaller than the opening cross-section of the connection of the other pressure space to the pressure medium pump.

3. The system for the relative rotating position change of a shaft with respect to the driving wheel according to claim 1, characterized in that the control cross-section of the connection of one pressure space to the pressure medium tank and the control cross-section of the connection of the other pressure space to the pressure medium pump is controlled by a common valve element of the control valve.

4. The system for the relative rotating position change of a shaft with respect to the driving wheel according to claim 3, characterized in that the common valve element of a control valve is utilized for both directions of the rotating position change.

5. The system for the relative rotating position change of a shaft with respect to the driving wheel according to claim 1, characterized in that the control valve is constructed as a 4/3 proportional way valve.

6. The system for the relative rotating position change of a shaft with respect to the driving wheel according to claim 2, characterized in that the control cross-section of the connection of one pressure space to the pressure medium tank and the control cross-section of the connection of the other pressure space to the pressure medium pump is controlled by a common valve element of the control valve.

7. The system for the relative rotating position change of a shaft with respect to the driving wheel according to claim 6, characterized in that a common valve element of a control valve is utilized for both directions of the rotating position change.

8. The system for the relative rotating position change of a shaft with respect to the driving wheel according to claim 2, characterized in that the control valve is constructed as a 4/3 proportional way valve.

9. The system for the relative rotating position change of a shaft with respect to the driving wheel according to claim 3, characterized in that the control valve is constructed as a 4/3 proportional way valve.

10. The system for the relative rotating position change of a shaft with respect to the driving wheel according to claim 4, characterized in that the control valve is constructed as a 4/3 proportional way valve.

11. The system for the relative rotating position change of a shaft with respect to the driving wheel according to claim 5, characterized in that the control valve is constructed as a 4/3 proportional way valve.

12. The system for the relative rotating position change of a shaft with respect to the driving wheel according to claim 6, characterized in that the control valve is constructed as a 4/3 proportional way valve.

13. The system for the relative rotating position change of a shaft with respect to the driving wheel according to claim 7, characterized in that the control valve is constructed as a 4/3 proportional way valve.

14. A camshaft rotational position adjusting system comprising:

two pressure spaces acting against one another, a pressure medium pump connected with one of the pressure spaces a pressure medium tank connected with the other of the pressure spaces, and a control arrangement operable during an adjusting to connect the one pressure space with the pressure medium pump before the other pressure space is connected with the pressure medium tank.

15. A system according to claim 14, characterized in that the control cross-section of the connection of one pressure space to the pressure medium tank during the adjusting operation is always smaller than the opening cross-section of the connection of the other pressure space to the pressure medium pump.

* * * * *